US007300031B2

(12) United States Patent
Bertsch et al.

(10) Patent No.: US 7,300,031 B2
(45) Date of Patent: Nov. 27, 2007

(54) COLLAPSIBLE BEVERAGE CONTAINER SUPPORTING APPARATUS

(75) Inventors: Patrick M. Bertsch, Thornton, CO (US); Brent W. Murray, Longmont, CO (US)

(73) Assignee: Eric Cordova, Fort Collins, CO (US)

( * ) Notice: Subject to any disclaimer, the term of this patent is extended or adjusted under 35 U.S.C. 154(b) by 85 days.

(21) Appl. No.: 11/041,150

(22) Filed: Jan. 24, 2005

(65) Prior Publication Data

US 2006/0175507 A1 Aug. 10, 2006

(51) Int. Cl.
*A47K 1/08* (2006.01)

(52) U.S. Cl. ..... 248/311.2; 248/315; 248/223.31; 248/223.41; 224/926; 224/483; 224/281

(58) Field of Classification Search ..... 248/311.2, 248/315, 223.31, 223.41; 224/926, 483, 224/281

See application file for complete search history.

(56) References Cited

U.S. PATENT DOCUMENTS 4,613,135 A * 9/1986 Rush ..... 473/488
4,828,211 A 5/1989 McConnell et al.
4,984,722 A 1/1991 Moore
5,014,956 A * 5/1991 Kayali ..... 248/311.2
5,072,909 A 12/1991 Huang
5,167,392 A 12/1992 Henricksen
5,318,266 A 6/1994 Liu
5,328,143 A * 7/1994 Koorey et al. ..... 248/311.2
5,342,009 A * 8/1994 Lehner ..... 248/311.2
5,423,508 A 6/1995 Isenga et al.
5,505,417 A * 4/1996 Plocher ..... 248/311.2
5,601,268 A 2/1997 Dunchock
5,603,477 A * 2/1997 Deutsch ..... 248/311.2
5,997,082 A * 12/1999 Vincent et al. ..... 297/188.19
6,047,937 A 4/2000 Huang
6,095,471 A 8/2000 Huang
6,227,509 B1 5/2001 Plocher et al.
6,371,428 B1 * 4/2002 Zorich et al. ..... 248/311.2
6,427,960 B1 * 8/2002 Gehring et al. ..... 248/311.2
6,481,679 B1 * 11/2002 Bennett et al. ..... 248/224.51
6,497,395 B1 * 12/2002 Croker ..... 248/300
6,520,575 B1 * 2/2003 Yuzawa ..... 297/188.01
6,527,240 B1 * 3/2003 Huang ..... 248/311.2
6,619,607 B2 9/2003 Yamada
6,655,563 B2 12/2003 Shimajiri
6,705,579 B2 3/2004 Yamada

* cited by examiner

*Primary Examiner*—Carl D. Friedman
*Assistant Examiner*—Michael McDuffie
(74) *Attorney, Agent, or Firm*—Harold A. Burdick

(57) ABSTRACT

A collapsible beverage container supporting apparatus is disclosed that includes a mounting framework having a first mount spaced from one end of the framework and a second mount located adjacent to the other end. A container stabilizer is pivotably secured at the first mount and is movable between a substantially perpendicular configuration relative to the framework and a stored configuration with the end thereof located adjacent to the one end of the framework. A container bottom support is pivotably located at the second mount and is movable from a stored deployment adjacent to the framework to a substantially perpendicular deployment. Corner mount openings in the tray and/or a rear wall of the framework are provided for receipt of selected sheet material (such as advertising).

19 Claims, 4 Drawing Sheets

COLLAPSIBLE BEVERAGE CONTAINER SUPPORTING APPARATUS

FIELD OF THE INVENTION

This invention relates to holders for cups, cans, bottles or the like, and, more particularly, relates to foldable holders for supporting a beverage container.

BACKGROUND OF THE INVENTION

Beverage container holders for use a various locations are in wide use. These holders allow a cup, can, bottle or the like to be secured so that a user may attend to other activities. Such holders are often made foldable or otherwise storable and redeployable (see U.S. Pat. Nos. 6,705,579, 6,655,563, 6,619,607, 6,277,509, 6,095,471, 6,047,937, 5,603,477, 5,601,268, 5,423,508, 5,318,266, 5,167,392, 5,072,909, 4,984,722, 4,828,2110).

Such heretofore known and/or utilized foldable devices for holding beverage containers are, however, often complex and bulky, require active mechanical components for initiating deployment, securement and/or restorage, and/or require unduly involved user intervention to initiate deployment, securement and/or restorage. Further improvement directed to such shortcomings would be useful.

SUMMARY OF THE INVENTION

This invention provides an improved beverage container supporting apparatus that is easily collapsible and securable for storage, and redeployed and secured for use completely by operation of gravity. The apparatus is simply constructed, light-weight and compact, and utilizes no active mechanical mechanisms for initiating or furthering deployment or restorage of apparatus components or for component securement in usable or stored deployments. The apparatus thus requires minimal user intervention to initiate deployment, securement and/or restorage.

The apparatus of this invention is well suited for use in public facilities such as rest rooms, hallways, sports venues, concert and dance halls, or any facility with limited seating. The apparatus includes a mounting framework with a rear wall between first and second end structures, first and second spaced mounts being located at one surface of the rear wall between the end structures. The first mount is spaced from the first end structure and the second mount is adjacent to the second end structure. A suspension structure is located at an opposite surface of the rear wall from the mounts.

A container stabilizer has a first end portion securable at the first mount for pivoting movement between a substantially perpendicular configuration relative to the framework and a stored configuration with a second end portion thereof located adjacent to the first end structure of the framework. A container bottom support is pivotably located at a first end section thereof at the second mount for movement from a stored deployment to a substantially perpendicular deployment relative to the framework for use of the apparatus, and after use toward the first end structure of the framework to the stored deployment with a second end section thereof located between the first end structure of the framework and the second end portion of the container stabilizer.

The container bottom support includes a tray which, in the stored deployment, is adjacent to the rear wall. A first surface receives a beverage container thereon when the tray is deployed for use, and a sheet material securement is located at an opposite surface of the tray for receipt of selected sheet material (plastic or paper advertising material, for example). A surface locating plate securable at a selected mounting surface is releasably receivable by the suspension structure at the rear wall of the framework. Additional sheet material positioners may be provided for receipt and securement of selected sheet material, for example at the surface of the rear wall of the framework exposed when the apparatus is deployed for use.

The second end portion of the container stabilizer is provided with an engageable lip, and the second end section of the container bottom support includes an engagement for engaging the lip at the stored configuration/deployment. When deployment for use of the apparatus is initiated by a user releasing the bottom support, the container stabilizer is pivoted into position automatically by virtue of the initial contact of the lip with the engagement.

It is therefore an object of this invention to provide an improved beverage container supporting apparatus.

It is another object of this invention to provide a beverage container supporting apparatus that is easily collapsible and securable for storage, and redeployed and secured for use by operation of gravity.

It is still another object of this invention to provide a collapsible beverage container supporting apparatus that is simply constructed, light-weight and compact, and utilizes no active mechanical mechanisms for initiating or furthering deployment or restorage of apparatus components or for component securement in usable or stored deployments.

It is yet another object of this invention to provide a collapsible beverage container supporting apparatus that requires minimal user intervention to initiate deployment, securement and/or restorage of apparatus components.

It is another object of this invention to provide a collapsible beverage container supporting apparatus including a mounting framework including first and second spaced mounts located between first and second end structures with the first mount spaced from the first end structure a selected distance and the second mount adjacent to the second end structure, a container stabilizer having first and second opposite end portions, the first end portion pivotably securable at the first mount for pivoting movement between a substantially perpendicular configuration relative to the framework and a stored configuration with the second end portion located adjacent to the first end structure of the framework, and a container bottom support pivotably located at the second mount, the bottom support pivotable from a stored deployment to a substantially perpendicular deployment relative to the framework, and pivotable toward the first end structure of the framework from the perpendicular deployment to the stored deployment.

It is still another object of this invention to provide a collapsible beverage container supporting apparatus including a mounting framework including a rear wall located between end structures and having first and second spaced mounts at one surface thereof between the first and second end structures and a suspension structure located at on opposite surface, a container stabilizer pivotably securable at the first mount for pivoting movement between a substantially perpendicular configuration relative to the rear wall of the framework and a stored configuration adjacent to the rear wall, a tray pivotably securable at the second mount for pivoting movement between a substantially perpendicular deployment relative to the rear wall of the framework and a stored deployment adjacent to the rear wall, the tray having first and second opposite surfaces with the first surface for receiving a beverage container thereon, a locating plate releasably receivable by the suspension structure at the rear wall of the framework, and at least one of the tray or the rear wall of the framework having a sheet material positioner/securement for receipt and securement of selected sheet material thereat.

It is yet another object of this invention to provide a collapsible beverage container supporting apparatus including a mounting framework including first and second spaced mounts located between first and second end structures, the first mount spaced from the first end structure a selected distance and the second mount adjacent to the second end structure, a container stabilizer having first and second opposite end portions, the first end portion pivotably securable at the first mount for pivoting movement between a substantially perpendicular configuration relative to the framework and a stored configuration with the second end portion located adjacent to the first end structure of the framework, the second end portion having a first engagement defined thereat, and a container bottom support having first and second opposite end sections, the first end section pivotably securable at the second mount for pivoting movement between a substantially perpendicular deployment relative to the framework and a stored deployment with the second end section located between the first end structure of the framework and the second end portion of the container stabilizer, the second end section having a second engagement defined thereat for engaging at the stored deployment the first engagement at the second end portion of the container stabilizer so that the container stabilizer pivots from the stored configuration to the perpendicular configuration when the bottom support is released for movement from the stored deployment to the perpendicular deployment.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
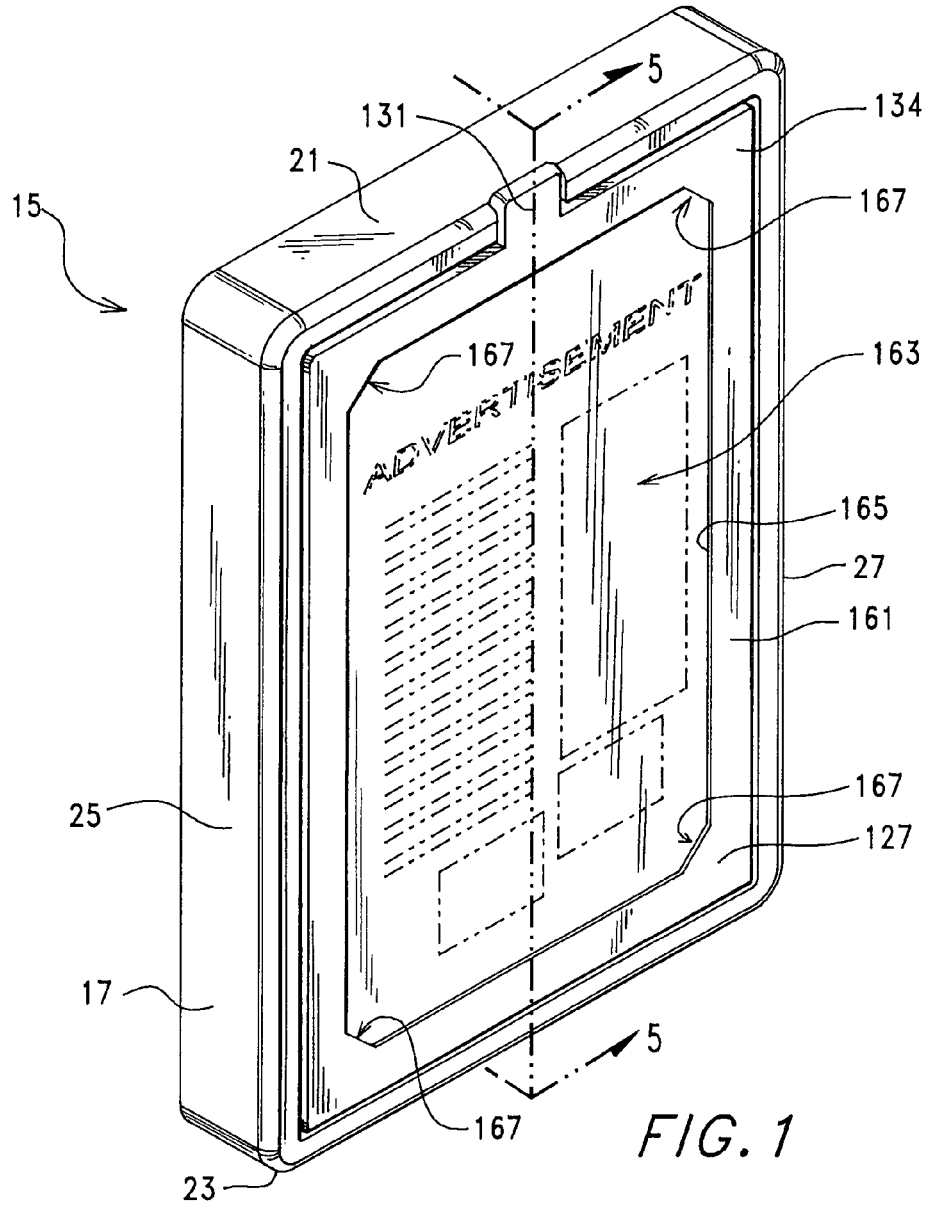
FIG. 1 is a perspective view of the collapsible supporting apparatus of this invention in the stored configuration.

A preferred embodiment 15 of the collapsible beverage container supporting apparatus of this invention is illustrated in FIGS. 1 through 5. The apparatus includes mounting framework 17 defined by rear wall 19 with end walls 21 and 23 and side walls 25 and 27 extending from inner surface 29 thereof. User actuation tab receiving notch 30 is located at the upper edge of top wall 21. For purposes of mounting and strength, side walls 25 and 27 and top end wall 21 are preferably formed as unshaped elements having inner and outer wall surfaces (see FIG. 5 as to top end wall 21, the others being like configured). Rear wall 19 is thereby suspended at the inner wall surfaces intermediate the full depth of the outer wall surfaces, thereby allowing flush mounting of framework 17 as may be appreciated as the description proceeds.

Mount configuration 31 (FIG. 2) is defined at inner surface 29 (preferably unitarily formed therewith) between end walls 21 and 23, spaced a selected distance from top wall 21. Mount configuration 31 includes mounting hubs 33 and 35 and cantilever shelf 37 configured to define guide cradle 39 (see FIG. 3). Mount configuration 41 is defined at inner surface 29 between end walls 21 and 23 and adjacent to bottom end wall 23 (preferably unitarily formed therewith). Mount configuration 41 includes pivot pins 43 and 45 at tabs 46 formed in the inner wall surfaces of walls 25/27 (only pin 45 at tab 46 of the inner surface of wall 27 is shown in the FIGURES, it being understood that pin 43 is identical and positioned directly opposite pin 45 at a tab 46 formed at the inner surface of wall 25), cantilever shelf 47 formed at the terminus of rear wall 19, and guide cradle 49 formed at the inner surface of bottom end wall 23 (see FIGS. 3 and 5).

Latch openings 53 and 55 (see FIG. 4) are formed through the inner wall surface of top wall 21 immediately adjacent to rear wall 19. Sheet material positioning configuration 57 is defined at inner surface 29 of rear wall 19, and includes surface depression 59 at inner surface 29 and corner mount openings 61. Depression 59 is in the shape and size of the largest sheet material (plastic or paper card for advertising or decorative material, mirrored metallic surface or the like) to be received thereat. Openings 61 open through surface 29 and rear wall 19 to the opposite (rear) surface 63 thereof. Spaced vertical guide tracks 67 and 69 and stops 71 and 73 are located (preferably unitary formed) at rear surface 63, and catch opening 75 is formed through wall 19 (see FIG. 4).

Container stabilizer 81 includes substantially circular container receiving opening 83 through shelf 85, circular support wall 87, side walls 89 and 91, and end wall 93 (part of end portion 94 opposite end portion 95) extending from bottom surface 97 of shelf 85. Engageble lip 101 is located at wall 93 or end portion 94. Pivot pins 103 and 105 at suspension bars 107 and 109, respectively, extending from shelf 85/side walls 89 and 91 intersection at end portion 95 (see FIGS. 2 through 4) are pivotably securable in the openings at hubs 33 and 35, respectively.

Figure 2:
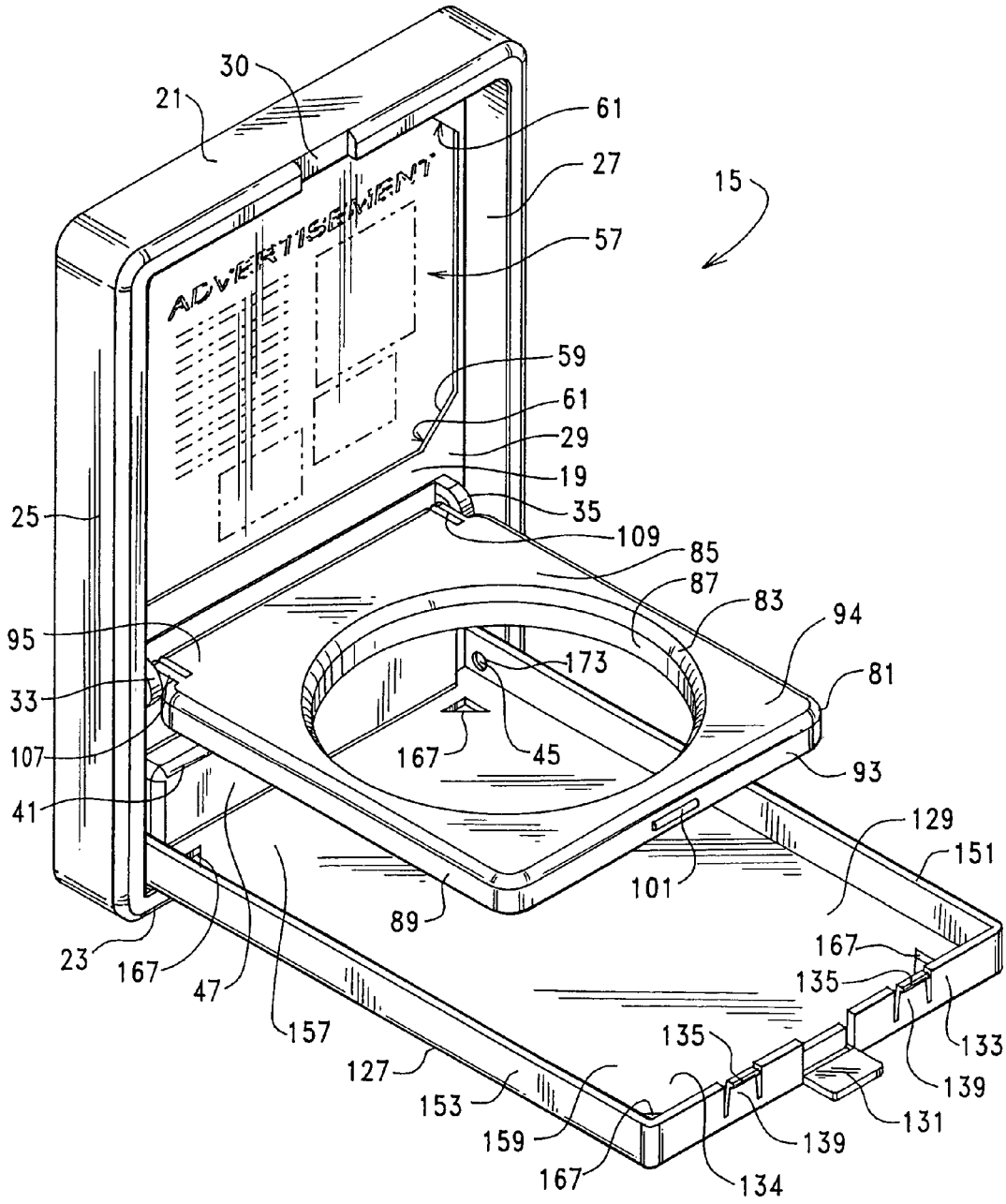
FIG. 2 is a perspective view of the apparatus of FIG. 1 in the deployed configuration.
Figure 3:
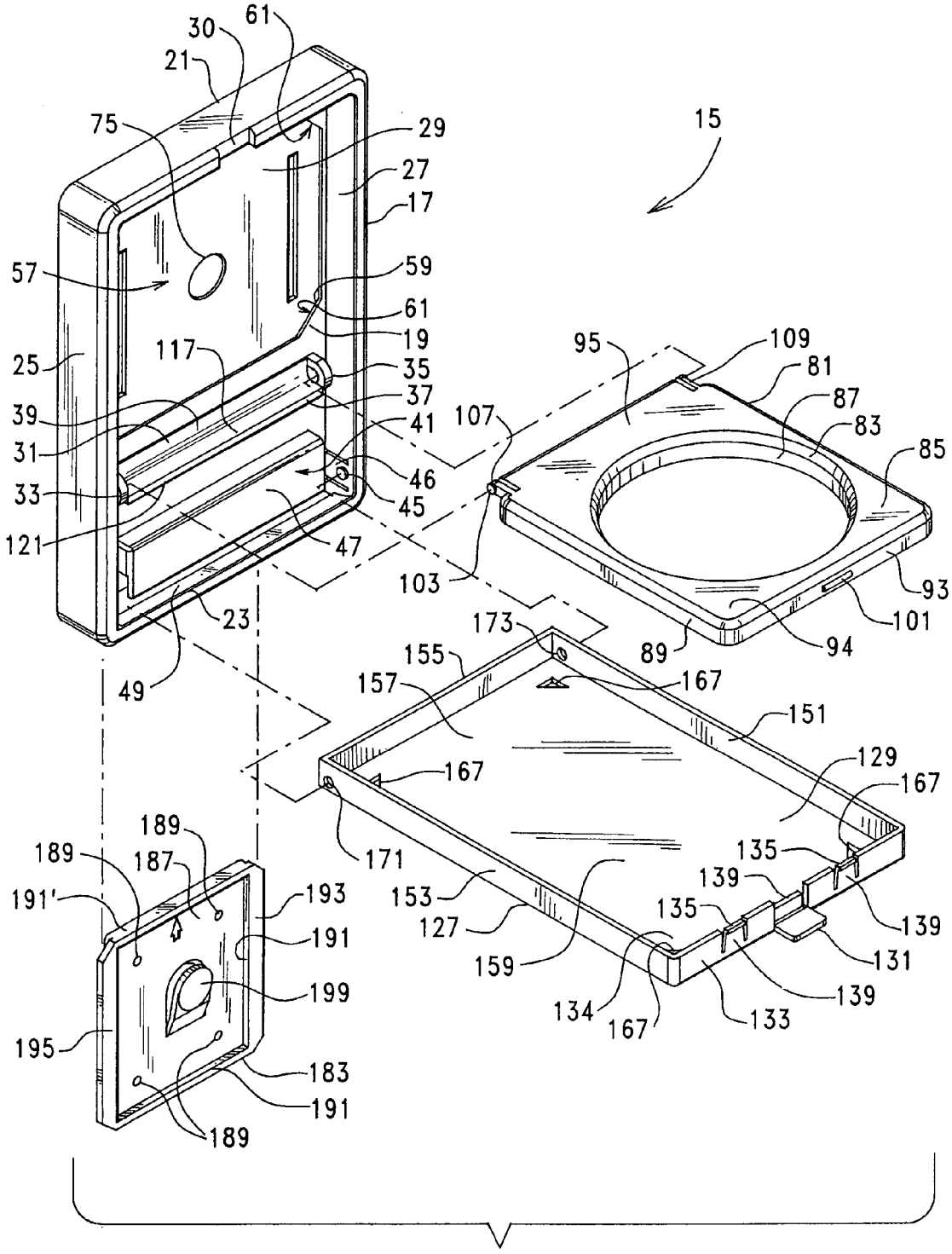
FIG. 3 is an exploded view of the apparatus of FIG. 1.
Figure 4:
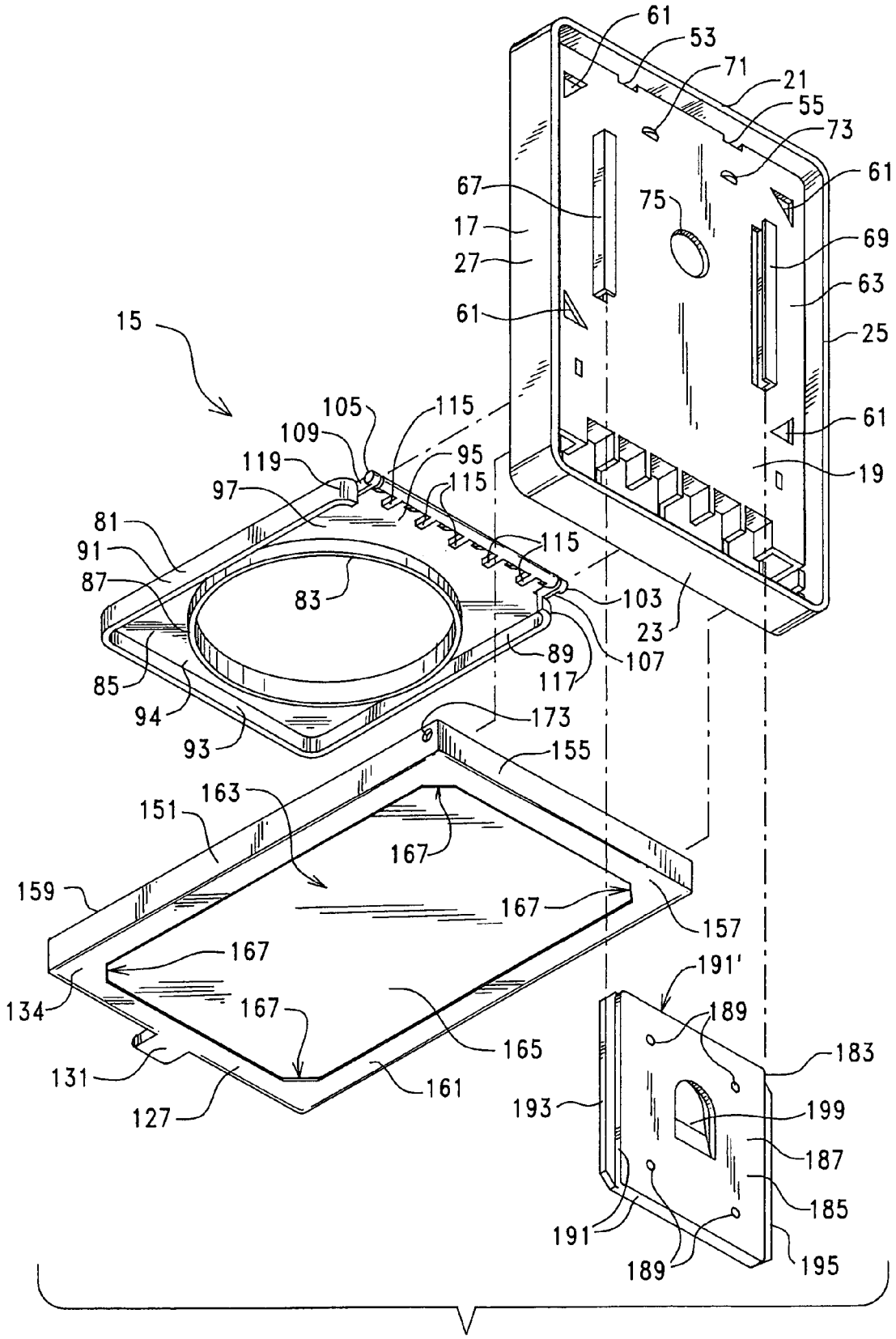
FIG. 4 is a reverse exploded view of the apparatus of FIG. 1.

When container stabilizer 81 is pivoted to its usable configuration substantially perpendicular to rear wall 19 of framework 17 as shown in FIG. 2, brace structures 115 at rear portion 95 come into contact with upper surface 117 of cantilever shelf 37 and curved end sections 117 and 119 of side walls 89 and 91, respectively, abut front surface 121 of shelf 37 (see FIGS. 3 and 4) thus supporting container stabilizer 81 thereat. As thus deployed, sheet material at positioning configuration 57 comes into view. When container stabilizer 81 is pivoted to its stored configuration adjacent to rear wall 19 of framework 17, end wall 93 of end portion 94 is adjacent to the inner wall surface of top end wall 21 of framework 17 but is not secured by framework 17 thereat (see FIG. 5).

Bottom support 127 is for receiving and supporting a container on inner surface 129 thereof when in its usable deployment substantially perpendicular relative to rear wall 19 of framework 17 as shown in FIG. 2. Support 127 includes user actuation tab 131 extending from end wall 133 of end section 134, tab 131 of a length sufficient to extend beyond end wall 121 of framework 17 when support 127 is at the stored deployment with end wall 133 between the inner surface of top end wall 21 of framework 17 and front end wall 93 of container stabilizer 81. Latching tabs 139 at end wall 133 include engaging lips 135 extending perpendicularly from the ends thereof, the tabs/lips engageable at latch openings 53/55 to secure both support 127 and container stabilizer 81 when apparatus 15 is in the stored configuration/deployment. Engagement tab 139 at end wall 133 includes lip 141 at the end thereof (see FIG. 5) which engages lip 101 of end wall 93 of container stabilizer 81 when both are at the stored configuration/deployment. In this way container stabilizer 81 is pivoted automatically from its stored configuration to its perpendicular configuration when bottom support 127 is released for pivoting movement from its stored deployment to the perpendicular deployment (i.e., container stabilizer 81 is drawn out of its vertical position in framework 17 by the engagement between lips 101 and 141 when support 127 is unlatched by user manipulation at tap 131).

Support 127 includes side walls 151 and 153 and rear end wall 155 at end section 157 which, together with end wall 133 defined tray 159. Tray 159 is preferably dimensioned to extend entirely between the inner surfaces of side walls 25/27 and end walls 21/23 of framework 17 in its stored deployment as shown in FIG. 1, though alternative designs are possible. Tray 159 has outer surface 161 defined opposite inner surface 129, outer surface 161 having sheet material securement 163 located thereat (see FIGS. 1 and 4). Securement 163 includes surface depression 165 at surface 161 and corner mount openings 167. Depression 165 is in the shape and size of the largest sheet material (plastic or paper card for advertising or decorative material, mirrored metallic surface or the like) to be received thereat. Openings 167 open through surface 161 to the opposite surface 129.

Pivot pins 43 and 45 at side walls 25 and 27, respectively, of framework 17 are receivable in pivot openings 171 and 173 at side walls 153 and 151, respectively, at end section 157 of support 127 for allowing pivoting movement of support 127/tray 159 between its perpendicular deployment when in use and its stored deployment. When pivoted by a user from the perpendicular deployment toward the stored deployment, surface 129 of support 127/tray 159 engages container stabilizer 81 at end wall 93 thereof between side walls 151 and 153 during its movement which in turn pivots container stabilizer 81 from its perpendicular configuration to its stored configuration (whereat, lips 101 and 141 are engaged).

Figure 5:
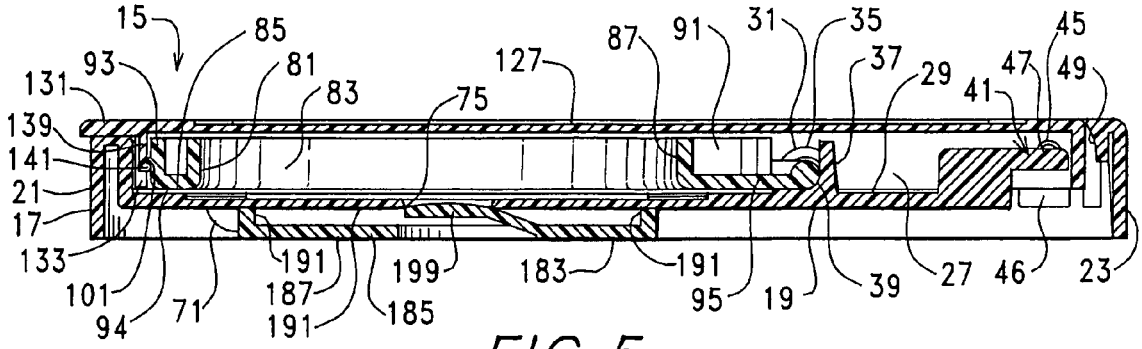
FIG. 5 is a sectional view taken through section lines 5-5 of FIG. 1.

Surface mounting of the apparatus of this invention is accomplished utilizing locating plate 183. Plate 183 is securable at any selected surface with surface 185 of plate wall 187 facing the selected surface and utilizing standard fasteners (screws, rivets or the like) through attachment openings 189 through wall 187. The depth (at side walls 191) of plate 183 is selected to achieve a firm surface mount of framework 17 (as illustrated in FIG. 5). Side flanges 193 and 195 are slidably receivable in tracks 67 and 69, respectively, with the uppermost of walls 191 (191') abutting stops 71 and 73 to seat plate 183. Resilient catch 199 is releasably received at opening 75 through rear wall 19 of framework 17 when framework 17 is slid into place and seated to further aid securement of framework 17 on plate 183. Release of framework 17 (for repair, replacement, cleaning, disinfecting or the like) from plate 183 is readily accomplished by user depression (or ramping depression) of catch 199 through opening 75 to allow sliding removal from plate 183.

Alternative embodiments of this invention could be conceived, for example providing more than one shelf/stabilizer 81. Sheet materials receivable in the various display areas of the apparatus could include decorative items and/or utility items such as reflective (mirrored) surfaces. Embodiments of the apparatus of this invention could be configured to include storage compartments for cell telephones or the like, an additional tray for food, and/or hooks or the like for hanging items such as keys or clothing. The apparatus could be configured for free standing application, and could be provided with springs or other return mechanisms for automatic return to the stored configuration/deployment of the stabilizers and support trays.

As may be appreciated, this invention can be utilized in a variety of locations for supporting known containers such as cans, bottles or cups (preferably sized and dimensioned to hold up to a standard 32 ounce beverage cup). The apparatus of this invention is simple to manufacture (utilizing molded plastic materials preferably, though metal materials could be utilized) and for a user to deploy for use and for return to the stored configuration/deployment.

No active mechanical components (springs or the like) are needed for deployment, securement or return of the support and stabilizing components in the preferred embodiment of the apparatus of this invention, deployment resulting from the effect of gravity on the support components after release by a user. Return of the support and stabilizing components to the stored configuration/deployment is accomplished by a single point of contact by the user to move the bottom support toward its store deployment.

What is claimed is:

1. A collapsible beverage container supporting apparatus comprising:

a mounting framework including first and second spaced mounts located between first and second end structures with said first mount spaced from said first end structure a selected distance and said second mount adjacent to said second end structure, first and second spaced side structures extending between said first and second end structures;

a container stabilizer having first and second opposite end portions, said first end portion pivotably securable at said first mount for pivoting movement between a substantially perpendicular configuration relative to said framework and a stored configuration with said second end portion located adjacent to said first end structure of said framework; and a container bottom support pivotably located at said second mount, said bottom support pivotable from a stored deployment to a substantially perpendicular deployment relative to said framework, and pivotable toward said first end structure of said framework from said perpendicular deployment to said stored deployment, said bottom support including a tray having dimensions selected to extend between said side structures and between said end structures of said framework when in said stored deployment, said tray engaging said container stabilizer when pivoted to said stored deployment to pivot said container stabilizer from said perpendicular configuration to said stored configuration.

2. The apparatus of claim 1 further comprising a surface locating plate securable at a selected surface and releasable receivable at said framework.

3. The apparatus of claim 2 wherein said framework includes a rear wall located between said end structures and having said first and second spaced mounts thereat, said rear wall having spaced tracks located on a surface opposite said mounts and configured to slidably receive said locating plate therebetween.

4. The apparatus of claim 2 wherein said framework includes a rear wall located between said end structures and having an opening thereat, said locating plate including a catch receivable at said opening to aid securement of said framework at the selected surface and to facilitate release of said framework from said locating plate thereafter by user pressure applied through said opening to said catch.

5. The apparatus of claim 1 wherein said bottom support includes first and second opposite end sections, said first end section pivotably securable at said second mount and said second end section located adjacent to said first end structure of said framework in said stored deployment, said second end section of said bottom support having a latch thereat engageable at said framework to secure said container stabilizer and said bottom support at said stored configuration and said stored deployment, respectively.

6. A collapsible beverage container supporting apparatus comprising:

a mounting framework including a rear wall located between end structures and having first and second spaced mounts at one surface thereof between said first and second end structures and a suspension structure located at an opposite surface;

a container stabilizer pivotably securable at said first mount for pivoting movement between a substantially perpendicular configuration relative to said rear wall of said framework and a stored configuration adjacent to said rear wall;

a tray pivotably securable at said second mount for pivoting movement between a substantially perpendicular deployment relative to said rear wall of said framework and a stored deployment adjacent to said rear wall, said tray having first and second opposite surfaces with said first surface for receiving a beverage container thereon, a sheet material securement being located at said tray for receipt of selected sheet material at said second surface; and a locating plate releasably receivable by said suspension structure at said rear wall of said framework.

7. The apparatus of claim 6 wherein said rear wall of said framework includes a sheet material positioner for receipt and securement of selected sheet material at said one surface of said rear wall.

8. The apparatus of claim 7 wherein said sheet material positioner includes at least one mounting opening through said rear wall for receipt of the selected sheet material.

9. The apparatus of claim 6 wherein said sheet material securement at said tray includes a depression at said second surface corresponding is size to the selected sheet material.

10. The apparatus of claim 6 wherein said sheet material securement at said tray includes corner mount openings for receipt of corners of the selected sheet material.

11. The apparatus of claim 6 wherein said container stabilizer includes a shelf having a substantially circular container receiving opening therethrough.

12. A collapsible beverage container supporting apparatus comprising:

a mounting framework including first and second spaced mounts located between first and second end structures, said first mount spaced from said first end structure a selected distance and said second mount adjacent to said second end structure;

a container stabilizer having first and second opposite end portions, said first end portion pivotably securable at said first mount for pivoting movement between a substantially perpendicular configuration relative to said framework and a stored configuration with said second end portion located adjacent to said first end structure of said framework, said second end portion having a first engagement defined thereat; and a container bottom support having first and second opposite end sections, said first end section pivotably securable at said second mount for pivoting movement between a substantially perpendicular deployment relative to said framework and a stored deployment with said second end section located between said first end structure of said framework and said second end portion of said container stabilizer, said second end section having a second engagement defined thereat for engaging at said stored deployment said first engagement at said second end portion of said container stabilizer so that said container stabilizer pivots from said stored configuration to said perpendicular configuration when said bottom support is released for movement from said stored deployment to said perpendicular deployment.

13. The apparatus of claim 12 wherein said bottom support includes a tray having dimensions selected to extend between said side structures and between said end structures of said framework when in said stored deployment, said tray engaging said container stabilizer when pivoted to said stored deployment to pivot said container stabilizer to said stored configuration.

14. The apparatus of claim 13 wherein said tray has a first surface and side walls extending from said first surface, said first surface for receiving a beverage container thereon, said second end portion of said container stabilizer coming into contact with said first surface between said side walls when said bottom support is pivoted to said stored deployment.

15. The apparatus of claim 12 wherein said second end section of said bottom support includes a latch engageable at said first end structure of said framework to secure said container stabilizer and said bottom support at said stored configuration and said stored deployment, respectively.

16. The apparatus of claim 12 further comprising a surface locating plate securable at a selected surface and releasable receivable at said framework.

17. The apparatus of claim 16 wherein said framework includes a rear wall located between said end structures having spaced tracks located on a surface opposite said mounts and configured to slidably receive said locating plate therebetween.

18. The apparatus of claim 17 wherein said rear wall has an opening thereat, said locating plate including a catch receivable at said opening to aid securement of said framework at the selected surface and to facilitate release of said framework from said locating plate thereafter by user pressure applied through said opening to said catch.

19. The apparatus of claim 12 wherein said container stabilizer includes a shelf between said first and second end portions having a substantially circular container receiving opening therethrough.

* * * * *